US010208739B2

(12) United States Patent
Bergstedt

(10) Patent No.: US 10,208,739 B2
(45) Date of Patent: Feb. 19, 2019

(54) MICROFLUIDIC PUMP WITH THERMAL CONTROL

(71) Applicant: Funai Electric Co., Ltd., Osaka (JP)

(72) Inventor: Steven W. Bergstedt, Winchester, KY (US)

(73) Assignee: Funai Electric Co., Ltd. (JP)

( * ) Notice: Subject to any disclaimer, the term of this patent is extended or adjusted under 35 U.S.C. 154(b) by 433 days.

(21) Appl. No.: 14/987,978

(22) Filed: Jan. 5, 2016

(65) Prior Publication Data

US 2017/0191473 A1 Jul. 6, 2017

(51) Int. Cl.

| | |
|---|---|
| ***F04B 19/00*** | (2006.01) |
| ***F04B 19/24*** | (2006.01) |
| *F04B 49/06* | (2006.01) |
| *F04B 49/10* | (2006.01) |

(52) U.S. Cl.

CPC ..... *F04B 19/006* (2013.01); *F04B 19/24* (2013.01); *B01L 2400/0442* (2013.01); *F04B 49/065* (2013.01); *F04B 49/10* (2013.01); *F04B 2201/0801* (2013.01)

(58) Field of Classification Search

CPC ..... F04B 19/006; F04B 19/24; F04B 2201/0801; B41J 2/0415; B41J 2/0458; B01L 2400/0442

See application file for complete search history.

(56) References Cited

U.S. PATENT DOCUMENTS

| | | | | |
|---|---|---|---|---|
| 5,300,968 | A * | 4/1994 | Hawkins | B41J 2/04541 323/313 |
| 5,375,979 | A * | 12/1994 | Trah | F04B 19/006 417/207 |
| 5,751,302 | A * | 5/1998 | Rezanka | B41J 2/04513 347/14 |
| 6,302,507 | B1 * | 10/2001 | Prakash | B41J 2/04506 347/14 |
| 6,572,830 | B1 | 6/2003 | Burdon et al. | |
| 6,984,516 | B2 | 1/2006 | Briscoe et al. | |
| 7,350,891 | B2 * | 4/2008 | Oomura | B41J 2/04513 347/9 |
| 7,517,042 | B2 * | 4/2009 | Espasa | B41J 2/04515 347/17 |

(Continued)

*Primary Examiner* — Devon C Kramer
*Assistant Examiner* — Christopher S Bobish
(74) *Attorney, Agent, or Firm* — Luedeka Neely Group, PC

(57) ABSTRACT

A microfluidic pump with thermal control. The microfluidic pump employs a fluid motivation mechanism that moves microscopic fluid volumes through a conduit using thermal vapor bubbles generated using supercritical heating. Aspects of the microfluidic pump include the use of a pump temperature controller that monitors temperatures associated with the microfluidic pump and slows or pauses operation of the microfluidic pump to reduce the rate at which heat is generated allowing additional time for heat to be passively dissipated. Controlling the upper microfluidic pump temperature prevents or reduces overheating of the fluid being pumped that renders the fluid less suitable or unsuitable for its intended purpose or harm to the microfluidic pump. Other aspects of the pump temperature controller include an optional substrate heater that helps raise the fluid temperature to a selected operational range for better performance of the fluid and/or the microfluidic pump.

18 Claims, 3 Drawing Sheets

(56) References Cited

U.S. PATENT DOCUMENTS

| | | | | |
|---|---|---|---|---|
| 7,938,500 | B2 * | 5/2011 | Sheahan | B41J 2/0451 347/17 |
| 8,891,949 | B2 | 11/2014 | Hong et al. | |
| 9,267,497 | B2 * | 2/2016 | Guan | F04B 19/006 |
| 9,533,302 | B2 * | 1/2017 | Edelen | B01L 3/0268 |
| 2003/0086790 | A1 * | 5/2003 | Ma | F04B 19/24 417/209 |
| 2006/0051214 | A1 * | 3/2006 | Ussing | B01J 19/0093 417/51 |
| 2007/0140041 | A1 | 6/2007 | Sparey-Taylor et al. | |
| 2008/0084445 | A1 * | 4/2008 | Sheahan | B41J 2/0451 347/17 |
| 2013/0202453 | A1 * | 8/2013 | Hong | F04B 19/006 417/53 |
| 2013/0288386 | A1 | 10/2013 | Fon et al. | |
| 2014/0377850 | A1 | 12/2014 | Handique et al. | |

* cited by examiner

Base Firing Pulse Signal $(T_{pump} < T_{max})$

Modified Firing Pulse Signal 1

$(T_{pump} > T_{max})$

Modified Firing Pulse Signal 2

$(T_{pump} > T_{max})$

MICROFLUIDIC PUMP WITH THERMAL CONTROL

CROSS-REFERENCE TO RELATED APPLICATIONS

Not Applicable.

BACKGROUND

Certain conventional non-mechanical microfluidic pumps utilize a series of pump heating elements fabricated on the substrate within a fluid transport channel to generate thermal vapor bubbles. The bubbles are typically created either at nucleation sites by raising the overall temperature of the fluid to the boiling point or by supercritical heating of a small portion of the fluid around the heating element to a temperature above the boiling point without significantly raising the overall fluid temperature. By sequencing the activation of the pump heating elements, the fluid flow is controlled.

Conventional microfluidic pumps employing thermal vapor bubbles to transport fluids rely on passive cooling to dissipate the heat generated during the creation of the thermal vapor bubbles. The rate of heat dissipation is determined by the volume, surface area, and thermal conductivity of conventional microfluidic pump components (e.g., the substrate) in thermal communication with the pump heating elements and the fluid. Conventional microfluidic pumps are designed with a heat dissipation rate intended to sufficiently cool the microfluidic pump and fluid when operating within a certain range of conditions (e.g., ambient temperature) at typical utilization levels with certain fluids. However, the designed heat dissipation rate is not always appropriate to accommodate the variations conditions, utilizations, and fluid compositions that are encountered.

If the passive cooling system is insufficient to dissipate the generated heat, the overall temperature of the fluid will rise over time as operation continues. In many cases, heating a fluid above a certain temperature has undesirable effects on the fluid composition (e.g., concentration of the fluid) or characteristics (e.g., reduced viscosity) that make the fluid unsuitable for a particular application or otherwise adversely affect the performance of the fluid (e.g., overspray or adherence) and, potentially, the microfluidic pump. At the same time, passive cooling system designs with higher heat dissipation rates may remove too much heat from the microfluidic pump preventing the fluid from reaching a minimum operating temperature in certain conditions, which may also adversely affect the characteristics (e.g., low flowability) or performance (e.g., poor dispersion or clumping) of the fluid and, potentially, the microfluidic pump. It is with respect to these and other consideration that the present invention was conceived.

BRIEF SUMMARY

The following summary discusses various aspects of the invention described more fully in the detailed description and claimed herein. It is not intended and should not be used to limit the claimed invention to only such aspects or to require the invention to include all such aspects.

The microfluidic pump with thermal control moves microscopic fluid volumes through a conduit using thermal vapor bubbles generated using supercritical heating. The thermally-controlled microfluidic pump is fabricated on a semiconductor substrate and includes a conduit that carries the fluid moved by the microfluidic pump. A series of spaced-apart pump heating elements are fabricated on the substrate along the length of the channel. The pump heating elements are resistive pump heating elements that are rapidly heated to cause supercritical heating of the fluid leading to formation of thermal vapor bubbles. By properly sequencing activation of the pump heating elements, the microfluidic pump dictates the movement (e.g., direction and flow rate) of the fluid.

A pump temperature controller in communication with the pump heating elements compares one or more temperatures associated with the microfluidic pump to corresponding temperature limits and modifies the firing pulse signal that drives the pump heating elements in order to maintain temperatures within a selected operational range intended to prevent harm to the fluid, or the microfluidic pump itself, due to overheating. The pump temperature controller includes a temperature monitor and a pump driver that drives the pump heating elements of the microfluidic pump to motivate the fluid through the conduit. The temperature monitor measures one or more temperatures associated with the microfluidic pump and produces an output signal corresponding to the difference between measured pump temperature and a reference temperature.

The pump driver produces a firing pulse signal that supplies activation energy to the pump heating elements. The firing pulse signal includes groups of pulses that activate the heating elements (i.e., a pump cycle) separated by an idle period during which the pump heating elements are not activated. The pump driver is responsive to the output of the temperature monitor allowing the firing pulse signal to be modified to provide control over the amount of heat generated by the microfluidic pump by controlling which heating elements are activated and how often the heating elements are activated. If the measured temperature exceeds a selected maximum temperature value, the pump driver modifies the firing pulse signal to reduce the number of heating elements activated, the time between activation of individual heating elements, and/or the time between pump cycles.

The pump temperature controller optionally controls a substrate heater that heats the substrate to warm the fluid to a selected operating temperature. The substrate heater encompasses one or more resistive heating elements and the substrate heater driver. The temperature monitor and the substrate heater form a thermal feedback loop allowing the substrate heater driver to respond to changes in the pump temperature. In various embodiments, the substrate heater driver includes a pulse width modulation circuit that generates an output signal that supplies energy to the substrate heating elements and regulates heat by varying the duty cycle of the modulated signal sent to the substrate heating elements.

BRIEF DESCRIPTION OF THE DRAWINGS

Further features, aspects, and advantages of the present disclosure will become better understood by reference to the following figures, wherein elements are not to scale so as to more clearly show the details and wherein like reference numbers indicate like elements throughout the several views.

DETAILED DESCRIPTION

A microfluidic pump with thermal control is described herein and illustrated in the accompanying figures. The microfluidic pump employs a fluid motivation mechanism that moves microscopic fluid volumes through a conduit using thermal vapor bubbles generated using supercritical heating. Aspects of the microfluidic pump include the use of a pump temperature controller that monitors temperatures associated with the microfluidic pump and slows or pauses operation of the microfluidic pump to reduce the rate at which heat is generated allowing additional time for heat to be passively dissipated. Controlling the upper microfluidic pump temperature prevents or reduces overheating of the fluid being pumped that renders the fluid less suitable or unsuitable for its intended purpose or harm to the microfluidic pump. Other aspects of the pump temperature controller include an optional substrate heater that helps raise the fluid temperature to a selected operational range for better performance of the fluid and/or the microfluidic pump.

Figure 1:
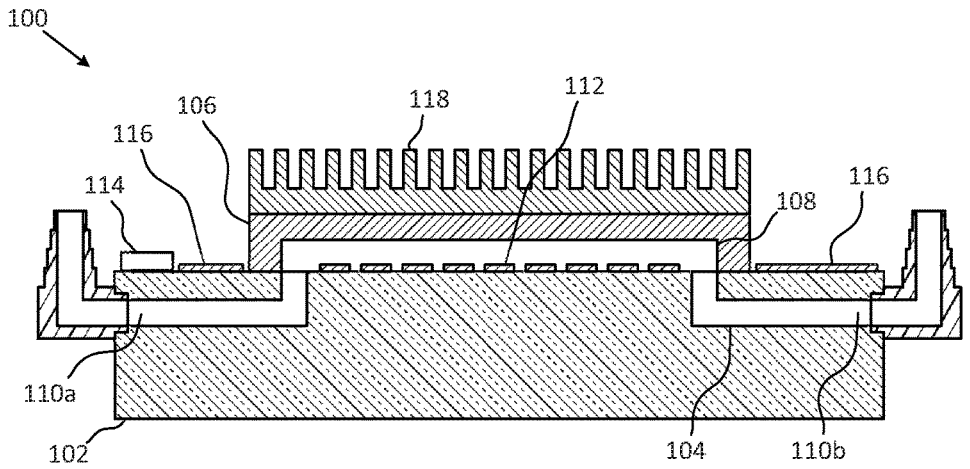
FIG. 1 is a simplified cross section showing aspects of a microfluidic pump with thermal control according to the present invention.

FIG. 1 is a simplified cross section showing aspects of a microfluidic pump with thermal control according to the present invention. The thermally-controlled microfluidic pump 100 is preferably implemented as a micro-electro-mechanical system (MEMS), such as a lab-on-a-chip (LOC) device, or other micromachine. More specifically, the thermally-controlled microfluidic pump 100 is fabricated on a substrate 102. A channel 104 formed in the substrate 102 provides a travel path for a fluid. Some portion of the channel 104 is open on one side (e.g., the top surface of the substrate). A cover 106 secured to the substrate 102 above the channel 104 via a fluid-tight seal, together with the channel 104, form a conduit 108. The conduit 108 defines the passage that carries the fluid moved by the microfluidic pump 100. Each end of the conduit 108 defines a port 110*a*, 110*b* that serves an inlet or outlet for the microfluidic pump 100. In the illustrated embodiment, the ports are fitted with optional connectors that allow the microfluidic pump to be placed in fluid communication with other components, either directly or via fluid supply and/or distribution lines. In other embodiments, other fixtures or devices, including without limitation, nozzles and reservoirs, may be integrated with the microfluidic pump 100 in place of the connectors, to implement special purpose fluid dispensers (e.g., pressurized fluid dispersion devices) for precise delivery of the subject fluid.

A series of spaced-apart pump heating elements 112 are fabricated on the substrate 102 along the length of the channel 104. The pump heating elements 112 are resistive pump heating elements 112 with a small volume that facilitates a rapid (e.g., near-instantaneous) temperature increase sufficient to cause supercritical heating of the fluid and the resultant formation of thermal vapor bubbles. By properly sequencing activation of the pump heating elements 112, the microfluidic pump 100 dictates the movement (e.g., direction and flow rate) of the fluid.

A pump temperature controller 114 in communication with the pump heating elements 112 compares one or more temperatures associated with the microfluidic pump 100 to corresponding temperature limits and modifies the firing pulse signal that drives the pump heating elements 112 in order to maintain temperatures within a selected operational range intended to prevent harm to the fluid, or the microfluidic pump 100 itself, due to overheating. Incorporating the ability to actively reduce heat generation when overheating is detected into the microfluidic pump 100 offers significant advantages by reducing or eliminating adverse effects on the fluid being pumped that reduce the suitability of the fluid for the intended purpose.

The pump temperature controller 114 optionally controls a substrate heater 116 that heats the substrate to warm the fluid to a selected operating temperature. For example, the substrate heater 116 may be used to heat the fluid to a temperature that improves one or more selected fluid characteristics, such as, but not limited to, flowability, dispersion, or absorption. The ability of the pump temperature controller 114 to control minimum temperatures via the substrate heater 116 improves performance of the microfluidic pump in sub-optimal conditions, such as when the ambient temperature is below the suitable operating temperature of the fluid or in the case of "cold" starts following periods of inactivity. Finally, the illustrated embodiment of the microfluidic pump 100 includes an optional heat sink 118 in thermal communication with at least the cover 106 to increase the exposed surface area and, therefore, the passive heat dispersion rate.

Figure 2:
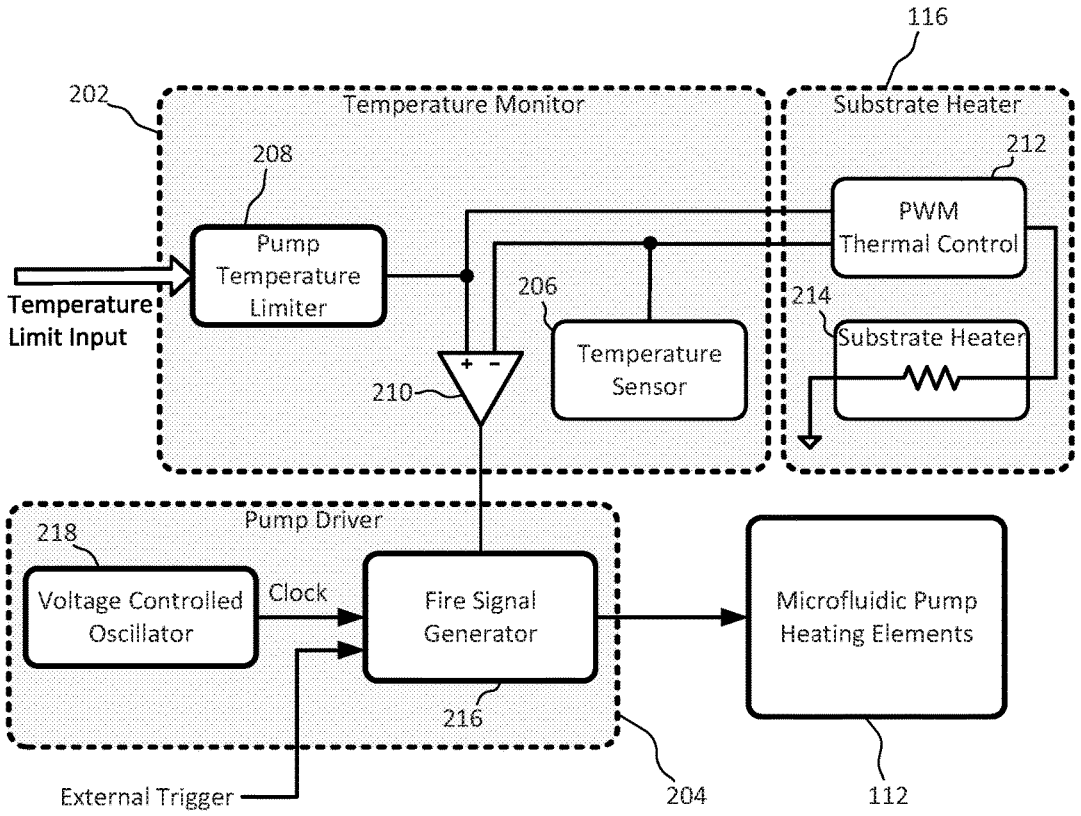
FIG. 2 is a simplified block diagram illustrating aspects of a pump temperature controller for the microfluidic pump of the present invention.

FIG. 2 is a simplified block diagram illustrating aspects of a pump temperature controller for the microfluidic pump of the present invention. The pump temperature controller 114 includes a temperature monitor 202 and a pump driver 204 that drives the pump heating elements 112 of the microfluidic pump 100 to motivate the fluid through the conduit 108.

Figure 4:
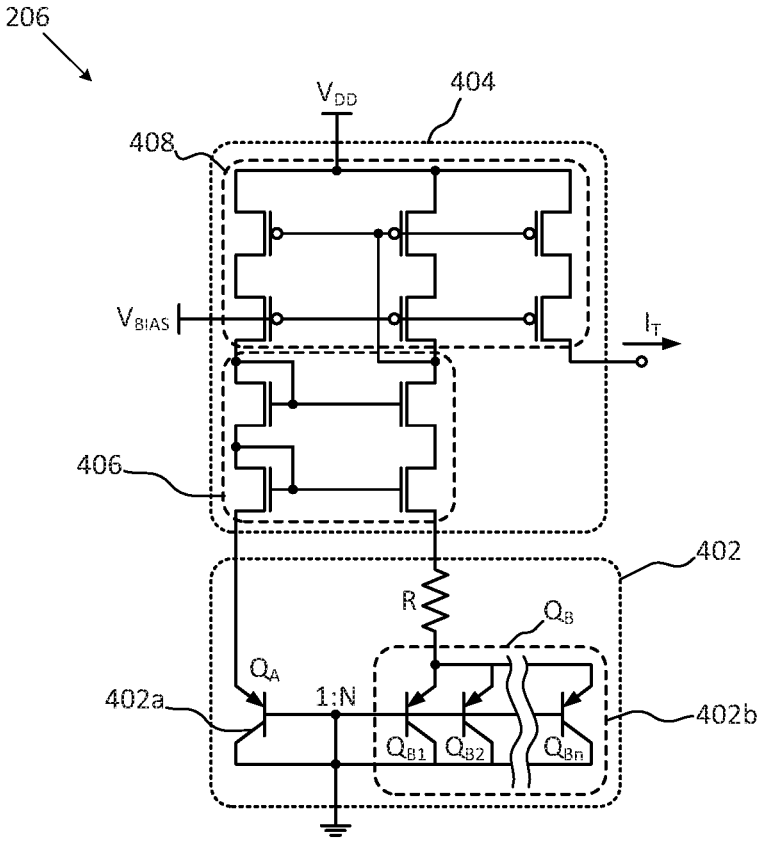
FIG. 4 illustrates an implementation of a temperature sensor suitable for fabrication on the substrate of a microfluidic pump according to the present invention.

The temperature monitor 202 generally includes a temperature sensor 206, a pump temperature limiter 208, and a comparison circuit 210. The temperature sensor 206 measures one or more temperatures associated with the microfluidic pump 100 and produces an output signal (e.g., a current or voltage signal) having a magnitude proportional to the temperature of the microfluidic pump 100. In a preferred embodiment, the output of the temperature sensor 206 corresponds to the temperature of the substrate 102 on which the temperature sensor 206 is fabricated; however, various embodiments may measure other temperatures, such as the fluid temperature. For convenience, the term "pump temperature" is used herein to broadly encompass any temperature associated with the microfluidic pump 100 measured by the temperature sensor 206, including, without limitation, the temperature of the substrate 102 or other component of the microfluidic pump 100 and the temperature of the fluid in the conduit 108. In various embodiments, the temperature sensor 206 is positioned so as to be in thermal communication with the microfluidic pump component from which the pump temperature, $T_{pump}$, is measured. One suitable implementation of the temperature sensor 206 for use in the pump temperature controller 114 to measure a substrate temperature is shown in FIG. 4 and described in relation thereto. Generally, the measured pump temperature is an average temperature value rather than an instantaneous or acute value.

The pump temperature limiter 208 receives a temperature limit input that specifies a reference temperature against which to evaluate the measured temperature and translates the temperature limit input to compatible format that is comparable to the output signal of the temperature sensor 206. In general, the reference temperature is selected as a temperature where a fluid characteristic relevant to the intended use of the fluid or the efficient operation of the microfluidic pump is adversely affected. For example, a reference temperature may be a temperature above which fluid viscosity drops below an acceptable level or above which the fluid composition breaks down. In some embodiments, the temperature limit input is generated by an external device, such as computing device directing operation of the microfluidic pump 100. In other embodiments, the pump temperature limiter includes one or more input devices used to configure a selected temperature limit.

Examples of suitable implementations of the pump temperature limiter 208 include circuitry for performing any necessary processing (e.g., amplifying, filtering, converting, or conditioning) of a temperature limit input to produce an appropriate signal for comparison with the signal output by the temperature sensor 206. Thus, some embodiments may incorporate a digital-to-analog convertor for receiving a digitally encoded temperature limit into an analog signal for comparison or sample and hold circuitry to store a temperature limit signal. The foregoing examples are not intended to restrict the scope of available implementations and alternatives of the pump temperature limiter 208. While a preferred embodiment of the temperature monitor 202 is implemented in analog circuitry, digital implementations may also be used, with appropriate modifications (e.g., use of an analog-to-digital converter, etc.).

In various embodiments, the reference temperature corresponds to a maximum temperature limit, $T_{max}$, (i.e., a temperature ceiling value or upper threshold). In other embodiments, a minimum temperature limit (i.e., a temperature floor value or lower threshold) or other temperature value (e.g., a target temperature or set point) may be specified in addition or as an alternative to the maximum temperature limit. In such cases, embodiments of the temperature monitor 202 include switching circuitry to switch between the available reference values for comparison purposes.

The basic implementation of the comparison circuit 210, depicted in the illustrated embodiment, includes a comparator that receives the analog temperature limit and measured temperature signal and produces an output corresponding to the difference between measured pump temperature and the reference temperature. More complex arithmetic and/or logical decision circuitry (e.g., digital logic circuits, processing units, or controllers) are suitable for implementations of the comparison circuit 210, particularly if the temperature monitor 202 is implemented digitally. However, the availability of many suitable and simpler analog implementations precludes the need for the added design complexity.

An additional aspect of the pump temperature controller 114 is the use of temperature monitor 202, or at least the temperature sensor 206, in the control of the substrate heater 116. The substrate heater 116 encompasses one or more substrate heating elements 212 and the substrate heater driver 214. Like the pump heating elements 112, the substrate heating elements 212 are typically resistive pump heating elements 112. However, the primary focus of the substrate heater 116 is to increase the overall fluid temperature to a minimum operating temperature (i.e., a minimum temperature limit) by heating the substrate 102 or other microfluidic pump components in thermal communication with fluid. While substrate heating elements 212 may have similar volumes and surface areas to the pump heating elements 112, the substrate heating element 212 may be fabricated with a larger volume in order to retain heat more uniformly over a longer period of time than is necessary for supercritical heating.

The minimum operating temperature corresponds to a temperature where a selected fluid begins to flow efficiently or exhibits other desirable characteristics intended to increase the suitability of the fluid for a particular application. By incorporating a dedicated substrate heater 116, the microfluidic pump 110 is not required to continuously pump the fluid in order to generate the desired heat. For example, the substrate heater 116 is operable to preheat the fluid and maintain the minimum fluid temperature for efficient pump operation. Similarly, the substrate heater 116 provides additional heat to compensate for excessive heat loss occurring when ambient conditions (e.g., the ambient temperature) are outside of the nominally designed operating range.

Together, the temperature monitor 202 and the substrate heater 116 form a thermal feedback loop allowing the substrate heater driver 214 to respond to changes in the pump temperature. In various embodiments, the substrate heater driver 214 includes a pulse width modulation circuit that generates an output signal that supplies energy to the substrate heating elements 212. More particularly, embodiments of the substrate heater driver 214 control the energy supplied by varying the duty cycle of the modulated signal sent to the substrate heating elements 212. Basically, if the substrate heater driver 214 determines the pump temperature is too low (i.e., below a minimum reference temperature), the duty cycle is increased. Similarly, the substrate heater driver 214 reduces the duty cycle of the modulated signal if the pump temperature exceeds minimum reference temperature. While the pump temperature matches the minimum reference temperature, the duty cycle is not changed. In various embodiments, the substrate heater driver 214 terminates generation of the modulated signal when the pump temperature exceeds the minimum reference temperature.

In various embodiments, the substrate heater driver 114 interfaces with the pump temperature limiter 208 to receive the reference temperature signal to be compared to the pump temperature using the comparison circuit 210 of the temperature monitor 202 via a switching arrangement or its own comparison circuit similar to that previously described. In some embodiments, the substrate heater driver 114 directly receives or is preconfigured with the minimum reference temperature used to determine the appropriate duty cycle.

The pump driver 204 includes a firing signal generator 216 in communication with a trigger generator 218. The firing signal generator 216 is also in communication with the pump heating elements 112. Using a clock signal received from the trigger generator 218, the firing signal generator 216 produces a firing pulse signal that supplies activation energy to the pump heating elements 112. A suitable device or circuit for the trigger generator 218 includes a voltage controlled oscillator or similar component. The voltage controlled oscillator allows the oscillation frequency and, therefore, the timing of the firing pulse signal. In some embodiments, the output of the temperature monitor 202 is used to directly influence the oscillation frequency based on the temperature differential (e.g., reducing the oscillator frequency when the pump temperature is greater than the maximum temperature limit. Alternatively, the firing signal generator 216 is responsive to a clock signal or other trigger provided by an external device to initiate generation of a firing pulse sequence and/or set the firing pulse signal timing.

In various embodiments, the firing signal generator 216 includes computation and/or logic circuitry that processes the output of the temperature monitor 202 to determine whether the base firing pulse signal should be modified to reduce the heat generated by the pumping operation and give the microfluidic pump 100 more opportunity to cool down. Generally, if the output of the temperature monitor 202 indicates that the pump temperature is too high (i.e., exceeds the temperature ceiling), the firing signal generator 216 reduces the energy supplied to the pump heating elements 112 during a given period time by manipulating one or more of the pulse width or pulse separation of individual pulses, the number of pulses occurring within a time period, or the separation time between groups of pulses. Operational details of the firing signal generator 216 are discussed in relation to the firing pulse signals illustrated in FIGS. 3A-C.

Figure 3A:
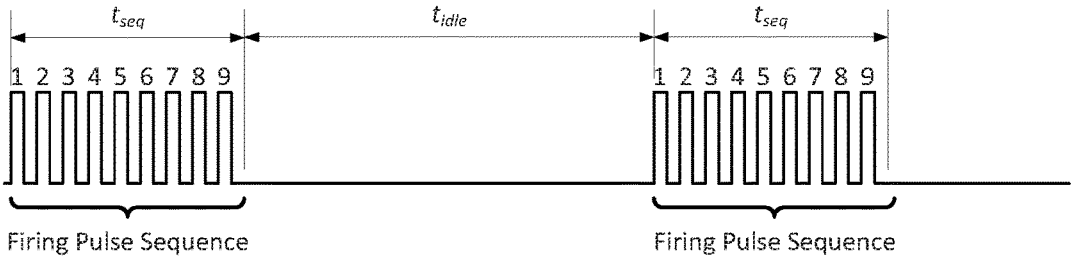
FIG. 3A illustrates an example of a base firing signal produced when the microfluidic pump temperature is below a reference temperature.

FIG. 3A illustrates an example of a base firing signal produced when the microfluidic pump temperature is below the temperature limit. The base firing signal includes a sequence of pulses arranged in groups (i.e., firing pulse sequences) corresponding to a pump cycle. In the base firing signal, the number of pulses is equal to the number of pump heating elements 112 that are fired during normal operation of the microfluidic pump. This is typically equal to the total number of pump heating elements 112 in the conduit; however, the number of pulses may be less than the total number of pump heating elements 112 in the conduit. In various embodiments, the pulse width is selected to provide the energy necessary for the heating element to generate sufficient heat for supercritical heating of the fluid. Within the group, the pulse separation determines the flow rate (i.e., how fast the thermal vapor bubbles are generated). In various embodiments, the pulse separation is tied to the clock cycles used to trigger the firing signal generator.

The length of the firing pulse sequence is the sum of pulse width and the pulse separation multiplied by the number of pulses in the firing sequence. The first pulse in the firing pulse sequence activates the first heating element in the microfluidic pump. Each subsequent pulse in the firing pulse sequence activates the next heating element in the series to create thermal vapor bubbles which forces the fluid to move in the desired direction. At the end of the firing pulse sequence or when the elapsed time from the first firing pulse in the sequence reaches the length of the firing pulse sequence, the pump cycle resets so the next firing pulse received will once again result in the activation of the first heating element.

The firing pulse sequences are separated by an idle period during which no pulses are produced. The idle period allows the heat generated during the pump cycle to dissipate. However, depending upon various factors, such as operating conditions (e.g., ambient temperature or the characteristics of the fluid being pumped) and usage (e.g., high volume use), the idle time may be insufficient to adequately dissipate the heat generated by the microfluidic pump during the previous pump cycle before the next pump cycle begins. Over time, the lack of adequate cooling has the potential to increase the fluid temperature to a level which has undesirable effects on the fluid.

Figure 3B:
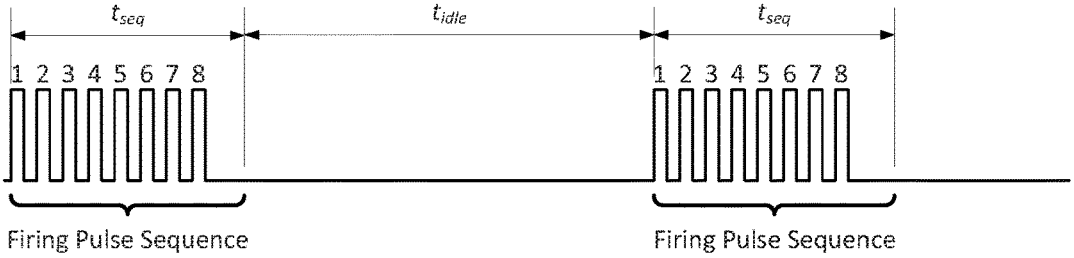
FIG. 3B illustrates aspects of a modified firing signal produced by the firing signal generator when the pump temperature exceeds the reference temperature.

FIG. 3B illustrates aspects of a modified firing signal produced by the firing signal generator when the pump temperature exceeds the temperature limit. As discussed above, the temperature-aware control circuit of the microfluidic pump address the problem of heat buildup by monitoring the pump temperature and adjusting the firing signal to reduce the amount of heat generated during pump cycles initiated while the pump temperature is above the temperature limit. One aspect of the modified firing signal involves a reduction in the number of pulses in the firing pulse sequence. In various embodiments, firing pulse sequences generated while the pump temperature is above the temperature limit have fewer pulses than occur in the base firing pulse sequence. Reducing the number of pulses in a firing pulse sequence reduces the number of pump heating elements 112 activated during the pump cycle. The length of the firing pulse sequence does not change. Thus, the pump cycles remain consistent, but the amount of heat generated during each pump cycle in which the firing signal generator issues the modified firing signal is reduced. In operational terms, fewer firing pulses results in a lower flow rate and/or pump efficiency, which are acceptable trade-offs to avoid the undesirable effects of overheating the fluid and rendering it unsuitable for use.

Aspects of the firing signal generator include the ability to employ fixed or variable amounts and/or rates of change of (i.e., increments and/or timings) and/or limits on the reduction in the number of firing pulses per pump cycle in order to lower the pump temperature. For example, the reduction amount may be fixed with the number of pulses in the modified firing pulse sequence is one less than the number of pulses in the base firing pulse sequence. In another example, the rate of change may be fixed such that the number of pulses in the each modified firing pulse sequence is one less the than the number of pulses in the previous firing pulse sequence. In various embodiments, the total amount of the reduction is limited to maintain a minimum flow rate. For example, the number of pulses in a modified firing sequence may not be reduced to less than half of the number of pulses in the base firing pulse sequence.

In some embodiments, the firing pulse reduction amount, rate of change, and/or limits thereon applied to the modified firing pulse sequences are conditionally varied from pump cycle to pump cycle by the firing signal generator based on the selected criteria, such as, but not limited to, the absolute pump temperature, the differential between the pump temperature and the temperature limit. For example, the number of firing pulses in the modified firing pulse sequence may be reduced by a first amount (e.g., one pulse) during each pump cycle where the pump temperature is within a first range above the temperature limit and a second greater amount (e.g., two pulses) during each pump cycle where the pump temperature is above the upper limit of the first range. Or, in another example, the number of the number of firing pulses in the modified firing pulse sequence may be reduced by one every third pump cycle while the pump temperature is within a first range above the temperature limit and reduced by one every pump cycle where the pump temperature is above the upper limit of the first range. The pulse reduction limits may be similarly varied, for example, to allow more reduction and/or rate of change as the difference between the pump temperature and temperature limit increases. Conditional firing pulse reduction parameters allows the firing signal generator to balance pump operation characteristics against the risk of undesirable effects on the fluid due to overheating. It will be appreciated that utilization of conditional firing pulse reduction parameters may require more complex logical circuitry or duplication of components (e.g., multiple pump temperature limit devices and comparators) in the temperature monitor 202 and/or the pump driver 204.

Figure 3C:
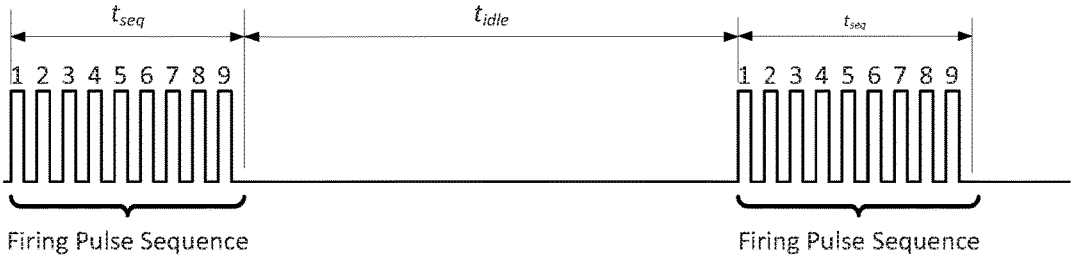
FIG. 3C illustrates an example of a modified firing signal produced by the firing signal generator when the microfluidic pump temperature exceeds the reference temperature.

FIG. 3C illustrates further aspects of a modified firing signal produced by the firing signal generator when the pump temperature exceeds the temperature limit. In this example of a modified firing signal, the firing signal generator increases the idle time between firing pulse sequences when the pump temperature is above the temperature limit. Increasing the idle time reduces the occurrence frequency of the firing pulse sequences and gives additional time for the heat generated during previous pump cycles to dissipate before more heat is produced.

The modified firing pulse signals of FIGS. 3B and 3C are not mutually exclusive. In other words, the firing signal generator 204 optionally produces a modified firing pulse signal combining a reduction in the number of pulses in each firing pulse sequence with an increased idle time. Finally, some embodiments of the firing signal generator 216 may limit the heat generated within any given period of time by reducing the duty cycle (e.g., reducing the pulse width relative to the current pulse separation or increasing the pulse separation relative to the current pulse width) of the individual pulses in the firing pulse sequences. Again, such duty cycle modifications may be combined with one or both of a reduction in the number of pulses in the firing pulse sequence and an increased idle time.

FIG. 4 illustrates aspects of a temperature sensor suitable for use with a temperature-controlled microfluidic pump according to the present invention. Generally, the temperature sensor 206 is a high-sensitivity bipolar junction transistor temperature sensor fabricated on a semiconductor substrate. In a preferred embodiment, the temperature sensor 206 is fabricated on a CMOS wafer substrate. The temperature sensor 206 includes identical substrate PNP bipolar junction transistors 402 with a high side cascode load 404 supplied by supply voltage $V_{DD}$. The cascode load 404 includes a NMOS cascode current mirror 406 connected to a PMOS cascode current amplifier 408. The PMOS cascode current amplifier 408 is biased with voltage $V_{BIAS}$, which is supplied by an external voltage bias circuit (not shown). Because the temperature sensor can have more than one stable operating state, a startup circuit (not shown) connected to the cascode load 404 ensures that the temperature sensor 206 starts in a desired operating state and prevents an undesirable zero voltage boundary condition state that can occur at startup when no current is flowing.

The substrate PNP bipolar junction transistors 402 are configured as a bandgap temperature sensor with a collector current ratio of 1:N by using a single transistor 402*a* on one side and a set of N transistors 402*b* connected in parallel on the other side or by fabricating transistors $Q_A$ and $Q_B$ with different emitter areas. The bandgap voltage is the difference in the base-emitter voltage ($V_{BE}$) of the single transistor 402*a* and the base-emitter voltage of the parallel transistors 402*b*. The bandgap voltage is proportional to the absolute temperature and appears across a resistor R. The current proportional to the absolute temperature of the substrate 102, $I_T$, is the total current through the depicted temperature sensor:

$$I_T = 12 \times \frac{kT}{qR} \times \ln N,$$

where k is Boltzmann's constant, T is absolute temperature (° K), q is the charge of an electron, R is the resistance, and N is the collector current ratio. The current in the bandgap temperature sensor branches is also proportional to the absolute temperature.

The microfluidic pump is not limited to the temperature sensor of FIG. 4. The illustrated embodiment of the temperature sensor is a non-limiting example of the wide variety of diode junction based temperature sensing circuits that may be used without departing from the scope and spirit of the present invention.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A microfluidic pump comprising:

a substrate defining a covered elongate conduit for carrying a fluid;

a series of resistive heaters disposed along the covered elongate conduit, wherein activating the resistive heaters in series from one resistive heater to a next resistive heater using a firing pulse sequence moves the fluid through the conduit in a direction and at a speed based on the firing pulse sequence;

a temperature sensor in thermal communication with the substrate, the temperature sensor measuring a pump temperature and producing a temperature signal corresponding to the pump temperature; and a fire signal generator in electrical communication with each resistive heater, the fire signal generator producing a series of firing pulse sequences, each firing pulse sequence consisting essentially of a number of firing pulses, successive firing pulses being separated by an idle period comprising a period of time with no firing pulses, the fire signal generator varying at least one of (1) the number of firing pulses in the firing sequence and (2) the idle period in response to the pump temperature.

2. The microfluidic pump of claim 1 wherein the number of firing pulses in the firing sequence is reduced when the pump temperature is above a temperature limit.

3. The microfluidic pump of claim 2 wherein the number of firing pulses in the firing sequence is reduced by one.

4. The microfluidic pump of claim 2 wherein the number of firing pulse the firing sequence is reduced by a selected number, the selected number based on the difference between when the pump temperature and a temperature limit.

5. The microfluidic pump of claim 4 wherein the selected number increases as the difference between the pump temperature and a temperature limit increases.

6. The microfluidic pump of claim 1 wherein the idle period is increased when the pump temperature is above a temperature limit.

7. The microfluidic pump of claim 1 further comprising at least one heat sink in thermal communication with at least one of the substrate and a cover covering the elongate conduit to dissipate heat from the fluid.

8. The microfluidic pump of claim 1 further comprising:

a substrate heater in thermal communication with the substrate, activation of the substrate heater heating the substrate; and a heater controller in communication with the temperature sensor, the heater controller activating the substrate heater to heat the substrate when the pump temperature is below a selected temperature.

9. The microfluidic pump of claim 1 further comprising:

a pump temperature limit signal generator producing a signal corresponding to a temperature limit; and a comparator in communication with the pump temperature limit signal generator and the temperature sensor, the comparator generating an output corresponding to the difference between the pump temperature and temperature limit.

10. The microfluidic pump of claim 1 further comprising a substrate heater having a substrate heater driver and at least one substrate heating element in communication with substrate heater driver, the substrate heater driver in communication with the temperature sensor, the substrate heater driver supplying an output to the substrate heating element causing the substrate heating element to generate heat when the pump temperature is below a selected minimum temperature.

11. The microfluidic pump of claim 10 wherein the substrate heater driver is a signal generator producing a pulse width modulated signal having a selected duty cycle, the substrate heater driver increasing the duty cycle when the pump temperature is below a minimum temperature.

12. A method of cooling a fluid being conveyed through a microfluidic pump, the microfluidic pump having a series of resistive heaters disposed along a substrate in an elongate conduit carrying the fluid, a temperature sensor in thermal communication with the substrate, and a firing signal generator in communication with the temperature sensor and the resistive heaters, and at least one additional resistive heater in thermal communication with the substrate, the method comprising:

producing a firing signal containing energy to activate the series of resistive heaters, the firing signal producing a series of periodic firing pulse sequences, each firing pulse sequence consisting essentially of a number of firing pulses, successive firing pulses being separated by an idle period comprising a period of time with no firing pulses;

activating at least some of the series of resistive heaters from one resistive heater to a next resistive heater using the firing signal to heat the fluid such that the fluid moves through the elongate conduit;

measuring a pump temperature using the temperature sensor;

reducing the energy supplied by the firing signal when the pump temperature is above a selected temperature limit; and supplying a modulated signal to activate the additional resistive heater and heat the substrate until the pump temperature reaches a selected minimum temperature.

13. The method of claim 12 wherein the act of reducing the energy supplied by the firing signal further comprises reducing the number of pulses in the firing pulse sequence while the pump temperature is above a selected temperature limit.

14. The method of claim 12 further comprising the acts of:

determining the difference between the pump temperature and the selected temperature limit; and determining a reduction value by which to reduce the number of pulses based on the magnitude of the difference between the pump temperature and the selected temperature limit and a rate of heat dissipation from the microfluidic pump; and reducing the number of firing pulses in the firing pulse sequence by the reduction value.

15. The method of claim 12 wherein the act of reducing the energy supplied by the firing signal further comprises increasing the idle period while the pump temperature is above a selected temperature limit.

16. The method of claim 12 further comprising the act of heating the substrate until a selected temperature is reached.

17. A microfluidic pump comprising:

a substrate defining a covered elongate conduit for carrying a fluid and having a rate of heat dissipation;

a series of resistive heaters disposed along the covered elongate conduit, wherein activating the resistive heaters in series from one resistive heater to a next resistive heater using a firing pulse sequence moves the fluid through the elongate conduit in a direction and at a speed based on the firing pulse sequence;

a temperature sensor in thermal communication with the substrate, the temperature sensor measuring a pump temperature and producing a temperature signal corresponding to the pump temperature; and a fire signal generator in electrical communication with each resistive heater, the fire signal generator producing a series of firing pulse sequences, each firing pulse sequence consisting essentially of a number of firing pulses, successive firing pulses being separated by an idle period comprising a period of time with no firing pulses, the fire signal generator reducing the energy in the firing pulse sequence when the pump temperature is above a temperature limit.

18. The microfluidic pump of claim 17 wherein the fire signal generator determines a difference between the pump temperature and the temperature limit and reduces the energy in the firing pulse sequence by at least one of reducing of the number of firing pulses in the firing sequence and increasing the idle period in response to the pump temperature, the energy reduction based on the difference and the rate of heat dissipation.

* * * * *